US005440987A

United States Patent [19]

Williams et al.

[11] Patent Number: 5,440,987

[45] Date of Patent: * Aug. 15, 1995

[54] LASER IMAGED SEAMLESS LITHOGRAPHIC PRINTING MEMBERS AND METHOD OF MAKING

[75] Inventors: Richard A. Williams, Hampstead; Thomas E. Lewis, E. Hampstead, both of N.H.

[73] Assignee: Presstek, Inc., Hudson, N.H.

[ * ] Notice: The portion of the term of this patent subsequent to Aug. 23, 2011 has been disclaimed.

[21] Appl. No.: 186,143

[22] Filed: Jan. 21, 1994

[51] Int. Cl.[6] ..... B41N 1/08

[52] U.S. Cl. ..... 101/454; 101/457; 101/467

[58] Field of Search ..... 101/453, 454, 457–459, 101/462, 463.1, 465–467, 140, 141, 216, 195, 375, 401.1, 478

[56] References Cited

U.S. PATENT DOCUMENTS

| | | | |
|---|---|---|---|
| 637,562 | 11/1899 | Hett | 101/140 |
| 662,861 | 11/1900 | Hett | 101/135 |
| 3,166,013 | 1/1965 | Wyllie et al. | 101/378 |
| 3,250,644 | 5/1966 | Marcus | 101/467 |
| 3,945,318 | 3/1976 | Landsman | 101/467 |
| 3,962,513 | 6/1976 | Eames | 428/323 |
| 3,964,389 | 6/1976 | Peterson | 101/467 |
| 4,054,094 | 10/1977 | Caddell et al. | 101/467 |
| 4,063,949 | 12/1977 | Uhlig et al. | 101/471 |
| 4,116,715 | 9/1978 | Smiggen et al. | 101/467 |
| 4,132,168 | 1/1979 | Peterson | 101/467 |
| 4,842,988 | 6/1989 | Herrmann et al. | 430/14 |
| 4,842,990 | 6/1989 | Herrmann et al. | 430/272 |
| 4,913,048 | 4/1990 | Tittgemeyer | 101/141 |
| 5,053,311 | 10/1991 | Makino et al. | 430/166 |
| 5,072,671 | 12/1991 | Schneider et al. | 101/401.1 |
| 5,147,490 | 9/1992 | Leenders et al. | 156/238 |
| 5,156,938 | 10/1992 | Foley et al. | 430/200 |
| 5,171,650 | 12/1992 | Ellis et al. | 430/20 |
| 5,339,737 | 8/1994 | Lewis et al. | 101/454 |
| 5,366,844 | 11/1994 | Verburgh et al. | 430/258 |
| 5,378,580 | 1/1995 | Leenders | 101/467 |

FOREIGN PATENT DOCUMENTS

| | | |
|---|---|---|
| 0573091 | 12/1993 | European Pat. Off. . |
| 0573091 | 12/1993 | European Pat. Off. . |

OTHER PUBLICATIONS

Research Disclosure, Apr. 1980, at p. 131.

*Primary Examiner*—Edgar S. Burr
*Assistant Examiner*—Stephen R. Funk
*Attorney, Agent, or Firm*—Cesari and McKenna

[57] ABSTRACT

Seamless, sleeve-shaped dry and wet lithographic printing members that can be recycled after use along with methods for their manufacture and use. The members include a strong, durable, hollow cylinder or sleeve that is attached to the plate mandrel or cylinder jacket of an offset printing press or platemaking apparatus. Surrounding the sleeve is a layer of a material, preferably polymeric in nature, which is characterized by efficient, ablative absorption of laser radiation, as well as other layers that facilitate imaging and subsequent printing.

25 Claims, 2 Drawing Sheets

LASER IMAGED SEAMLESS LITHOGRAPHIC PRINTING MEMBERS AND METHOD OF MAKING

BACKGROUND OF THE INVENTION

A. Field of the Invention

The present invention relates to digital printing apparatus and methods, and more particularly to lithographic printing members for use with laser-discharge imaging devices.

B. Description of the Related Art

U.S. Pat. No. 5,339,737, hereby incorporated by reference, discloses a variety of lithographic plate configurations for use with imaging apparatus that operate by laser discharge. These include "wet" plates that utilize fountain solution during printing, and "dry" plates to which ink is applied directly.

All of the disclosed plate constructions incorporate materials that enhance the ablative efficiency of the laser beam. This avoids a shortcoming characteristic of prior systems, which employ plate substances that do not heat rapidly or absorb significant amounts of radiation and, consequently, do not ablate (i.e., decompose into gases and volatile fragments) unless they are irradiated for relatively long intervals and/or receive high-power pulses. The disclosed plate materials are all solid and durable, preferably of polymeric composition, enabling them to withstand the rigors of commercial printing and exhibit adequate useful lifespans.

In one disclosed embodiment, the plate construction includes a first layer and a substrate underlying the first layer, the substrate being characterized by efficient absorption of infrared ("IR") radiation, and the first layer and substrate having different affinities for ink or an ink-abhesive fluid. Laser radiation is absorbed by the substrate, and ablates the substrate surface in contact with the first layer; this action disrupts the anchorage of the substrate to the overlying first layer, which is then easily removed at the points of exposure. The result of removal is an image spot whose affinity for ink or the ink-abhesive fluid differs from that of the unexposed first layer.

In a variation of this embodiment, the first layer, rather than the substrate, absorbs IR radiation. In this case the substrate serves a support function and provides contrasting affinity characteristics.

In both of these two-ply plate types, a single layer serves two separate functions, namely, absorption of IR radiation and interaction with ink or an ink-abhesive fluid. In a second embodiment, these functions are performed by two separate layers. The first, topmost layer is chosen for its affinity for (or repulsion of) ink or an ink-abhesive fluid. Underlying the first layer is a second layer, which absorbs IR radiation. A strong, durable substrate underlies the second layer, and is characterized by an affinity for (or repulsion of) ink or an ink-abhesive fluid opposite to that of the first layer. Exposure of the plate to a laser pulse ablates the absorbing second layer, weakening the topmost layer as well. As a result of ablation of the second layer, the weakened surface layer is no longer anchored to an underlying layer, and is easily removed. The disrupted topmost layer (and any debris remaining from destruction of the absorptive second layer) is removed in a post-imaging cleaning step. This, once again, creates an image spot having an affinity for ink or an ink-abhesive fluid differing from that of the unexposed first layer.

An alternative to the foregoing constructions that provides improved performance in some circumstances is disclosed in U.S. Pat. No. 5,353,705 hereby incorporated by reference. The '705 patent introduces a "secondary" ablation layer that volatilizes in response to heat generated by ablation of one or more overlying layers. In a typical construction, a radiation-absorbing layer underlies a surface coating chosen for its interaction with ink and/or fountain solution. The secondary ablation layer is located beneath the absorbing layer, and may be anchored to a substrate having superior mechanical properties. It may be preferable in some instances to introduce an additional layer between the secondary ablation layer and the substrate to enhance adhesion therebetween.

Most plate constructions currently in use are imaged by means of imagewise photoexposure, followed by standard photochemical development. A recent variation of this approach, exemplified by the Polychrome CTX material, utilizes constructions based on a substrate, a layer of photohardenable material, and a surface layer that contains conventional silver halide grains. Imagewise exposure of the first layer (e.g., by an imaging laser) to radiation to which it, but not the photopolymer is sensitive, followed by chemical development, results in a mask that bears the image pattern and overlies the as-yet unexposed photopolymer. The construction is then subjected to radiation to which the photopolymer is sensitive. The exposed portions of the mask prevent passage of actinic radiation to the photopolymer, while radiation passes freely through unexposed regions, resulting in an imagewise exposure of the photopolymer that is negative with respect to the initial mask exposure, and which anchors the photopolymer to the substrate. The mask and unexposed photopolymer are then removed. See, e.g., *What's New(s) in Graphic Communications*, September–October 1993, p. 4.

A variant of this approach to imaging is described in U.S. Pat. No. 5,102,756, which discusses plates that include a base layer, a layer of photohardenable material, and a surface layer of photosensitive marking material containing particles that migrate in response to light and electricity. The surface is exposed to an imagewise pattern of light under conditions that cause particle migration, rendering an otherwise opaque layer largely transparent. The construction is then exposed to radiation that cures the photohardenable material. That radiation penetrates only the areas of the surface layer that have been rendered transparent by the previous imagewise exposure, resulting in imagewise anchorage of the photohardenable layer to the base layer. The remaining photohardenable material, along with the marking layer, is then removed.

Any of the foregoing types of plate can be secured to the plate cylinder of a lithographic press for direct, on-press imaging, after which printing may commence. This configuration requires mechanical clamping mechanisms, and inevitably results in an angular "void" segment occupying the space between the top and bottom margins of the plate. The void prevents printing a continuous, unbroken image along of a web or strip of material, as is necessary for the production of decorative items such as wallpaper. Furthermore, the existence of this segment presupposes precise alignment and control assemblies to ensure proper registration of the plate image with the margins of the substrate to be printed.

The need for elaborate attachment measures arises from the traditional methods of imaging lithographic plates. These tend to be fabricated on graphic-arts production equipment, utilizing coaters and other application devices that operate most readily on flat sheets, after which the image is applied photographically. Imposing a photographic image onto a receptor ordinarily requires a flat receptor surface, as does the succeeding chemical development.

Once the impressions on an imaged lithographic plate have become worn or indistinct, the plate can no longer be used and is discarded. This practice can have unfortunate environmental and economic consequences, particularly in the case of plates that include hazardous materials. Recycling is expensive because of the difficulty of separating and recovering the different plate constituents; the plate must, in general be reconstructed entirely.

DESCRIPTION OF THE INVENTION

OBJECTS OF THE INVENTION

Accordingly, it is an object of the present invention to enable continuous lithographic printing.

It is a further object of the invention to provide a method of producing and printing with lithographic printing members that have no void segment.

It is another object of the invention to provide a method of producing lithographic printing members that does not require elaborate equipment.

It is yet another object of the invention to provide dry lithographic members suitable for continuous printing.

Yet a further object of the invention is to provide lithographic printing members that require no mechanical clamping arrangements.

Yet another object of the invention is to provide lithographic printing members that can be recycled.

Other objects will, in part, be obvious and will, in part, appear hereinafter.

The invention accordingly comprises an article of manufacture possessing the features and properties exemplified in the constructions described herein and the several steps and the relation of one or more of such steps with respect to the others and the apparatus embodying the features of construction, combination of elements and the arrangement of parts that are adapted to effect such steps, all as exemplified in the following summary and detailed description, and the scope of the invention will be indicated in the claims.

BRIEF SUMMARY OF THE INVENTION

The present invention enables straightforward manufacture of fully seamless, sleeve-shaped dry and wet lithographic printing members that can be recycled after use. In a first embodiment, the printing member comprises a strong, durable, hollow cylinder or sleeve that is attached to the plate mandrel or cylinder jacket of an offset printing press or platemaking apparatus. Surrounding the sleeve is a layer of a material, preferably polymeric in nature, which is characterized by efficient, ablative absorption of infrared ("IR") radiation. In other words, when exposed to the output of a laser having a peak output in the IR region of the electromagnetic spectrum, this layer will fully ablate or volatilize.

Surrounding the IR-sensitive layer is a surface coating whose affinity for ink or an ink-abhesive fluid is the opposite of that exhibited by the sleeve. Selective removal of this top layer by ablation of the underlying IR-sensitive layer (followed, if necessary, by cleaning) results in a pattern of spots having different affinities for ink or the ink-abhesive fluid, and corresponding to the image to be printed. By "different affinities" we mean good fluid acceptance (oleophilicity in the case of ink), on one hand, and fluid abhesion (oleophobicity in the case of ink) on the other. By "coating" we mean a layer that is applied in the form of liquid or uncured material that is subsequently brought to a solidified state, or by shrink-fitting a tubular sheet of material over the cylinder, or by other application processes such as spraying, vacuum evaporation, or powder coating followed by thermal fusion.

In a second embodiment, the hollow cylinder plays no part in the imaging process. Instead an additional layer having a selected affinity for ink or an ink-abhesive fluid is included between the cylinder surface and the IR-sensitive layer; this layer may be, for example, a secondary ablation material. The surface layer exhibits the opposite affinity.

In a third embodiment, the durability associated with traditional flood-exposed photopolymers are exploited in conjunction with laser imaging by coating a hollow cylinder with the photopolymer, and coating the photopolymer with a mask coating, opaque to radiation that is actinic with respect to the photopolymer, that is selectively ablated by the imaging laser. Subsequently, the imaged construction is exposed to actinic radiation, and the unexposed photopolymer, along with the overlying mask, is removed by ordinary chemical means. In the preferred version of this embodiment, the cylinder accepts fountain solution and the hardened photopolymer accepts ink.

In a fourth embodiment, a laser-ablation transfer ("LAT" ) material surrounds a cylinder, and is itself surrounded by a withdrawal layer. Exposure of the LAT layer (through the withdrawal layer) to laser radiation adheres the LAT layer to the cylinder, and the adhered layer exhibits an affinity for fountain solution and/or ink opposite to that exhibited by the cylinder. The withdrawal layer is peeled away following imagewise laser exposure, removing portions of the LAT layer that have not received laser radiation but leaving exposed portions adhered to the cylinder.

Using the materials described herein, the printing layers of most, if not all of the foregoing embodiments can be chemically stripped, and the hollow cylinder recoated and reused. The cylinder itself can be conveniently removed from the press for this purpose by disengagement of the mandrel or cylinder jacket.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
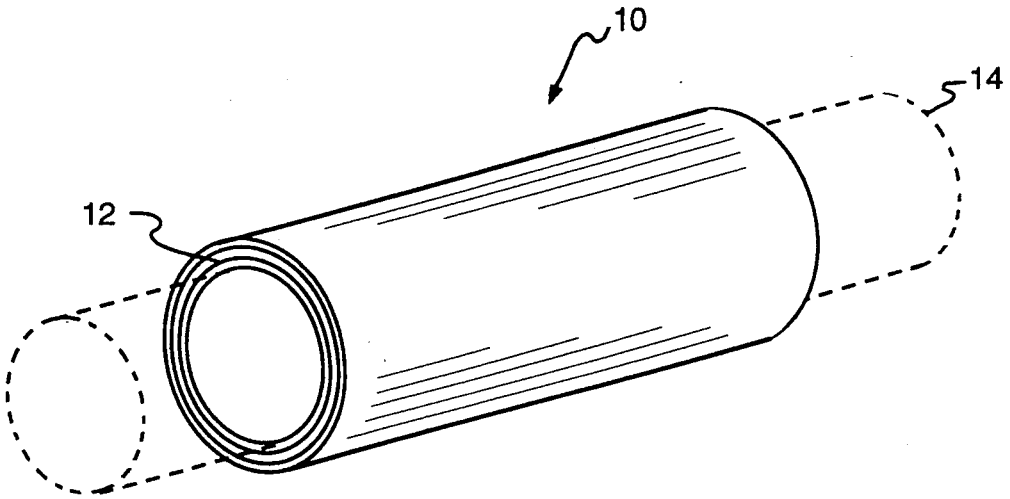
FIG. 1 is an isometric view of the first embodiment of the printing member of the present invention, with a press mandrel or cylinder jacket shown in phantom.

Refer first to FIG. 1, which shows the construction of a printing member, indicated generally by reference numeral 10, in accordance with the present invention. The member 10 includes a plurality of concentric layers 12, as further described below, which support a lithographic image for transfer to a printing substrate. The member 10 is fastened to a rotating mandrel or cylinder jacket 14, shown in phantom in FIG. 1, and which is associated with an offset printing press or a freestanding imaging apparatus.

Any number of suitable means can be used to secure printing member 10 to the rotating element 14. Preferably, element 14 contains an array of air capillaries that extend through its radial thickness. Air introduced from a compressed source into the interior of element 14 is directed radially outward from its surface, expanding the interior diameter of printing member 10 to ease its passage over element 14. When the member 10 is fully installed, the air flow is stopped, and member 10 relaxes to a tight fit over element 14. If member 10 is imaged on-press, the engagement must be firm enough to preclude relative movement between member 10 and element 14 during printing.

Numerous ways of uniting element 14 with rotational and other elements of the press or imaging apparatus are possible. In one arrangement, the ends of element 14 are off-round, and are mated with retractable clamps that engage bearings or a rotation-imparting motor. This approach permits full removal of element 14 from the body of the press or imaging apparatus. Alternatively, one side of element 14 can be permanently coupled to the motor or a bearing assembly by means of a hinge or joint with the other side fully disengageable, permitting the latter end to be freed and tilted away from the surrounding machinery for removal or installation of the printing member. Yet another alternative is to provide for full or partial disengagement of a section of the press (or imaging apparatus) housing, exposing and rendering accessible one end of element 14.

After imaging and/or printing has been completed, printing member 10 is removed from element 14 and replaced with a blank, which is itself imaged in preparation for the next print run. The printing member that has been removed may be recycled, as discussed below.

Figure 2:
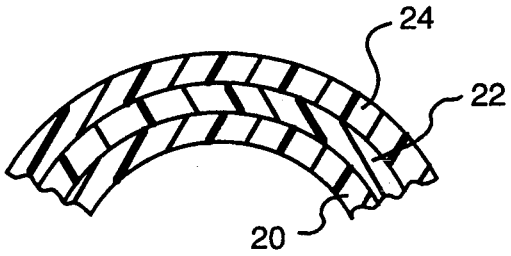
FIG. 2 is a partial end view of the embodiment illustrated in FIG. 1.

Refer now to FIG. 2, which shows the first embodiment of the printing member in greater detail. That embodiment includes a cylinder 20 onto which is coated a first polymeric layer 22 characterized by efficient, ablative absorption of infrared radiation. Surrounding layer 22 is a surface layer 24 that exhibits an affinity for ink or an ink-abhesive fluid which is opposite to that exhibited by layer 20.

In this embodiment, cylinder 20 can be a heavy polymeric material or a metal sheet. Cylinder 20 is sufficiently thick to provide the necessary dimensional stability during imaging and printing. In this regard, it may be desirable to utilize a laminated construction as described in U.S. Pat. No. 5,188,032 (the entire disclosure of which is hereby incorporated by reference), enabling use of commercial polyester products.

Layer 22 can consist of a polymeric system that intrinsically absorbs in the IR region, or a polymeric coating into which IR-absorbing components (such as one or more dyes and/or pigments) have been dispersed or dissolved. Suitable formulations are set forth in the '737 patent. Layer 22 is preferably applied to cylinder 20 by a spray device or by dip coating the latter in a tank containing the material of layer 22 in solution or in its molten state. In either case, the viscosity and solids level (in the case of a solution) is chosen such that the cylinder may be withdrawn at a commercially realistic rate, with drying or chilling occurring rapidly enough to retain the stability of layer 22 (avoiding sagging or dripping) during withdrawal. The final deposited weight of layer 22 is preferably at least 4 $g/m^2$, and most preferably 10–15 $g/m^2$, which ensures ablation using the low-power IR lasers described in the '737 patent.

In a dry-plate version of this embodiment, layer 24 is preferably based on one or more a silicone polymers. In a wet-plate version, layer 24 is preferably based on polyvinyl alcohol. Suitable formulations of both polymer systems are set forth in detail in the '737 patent. Once again, the polymer is applied to the cured or solidified layer 22 by dip coating to a deposited weight of 1–3 $g/m^2$ (and most preferably 2 $g/m^2$) in the case of silicone, and 1–2 $g/m^2$ in the case of polyvinyl alcohol. In either the wet-plate or the dry-plate version, cylinder 20 can be an oleophilic polymer such as nylon, acrylic or polycarbonate, or an oleophilic metal such as nickel.

Figure 3:
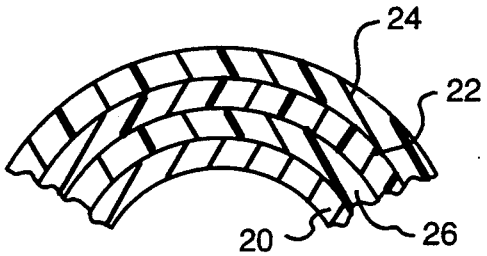
FIG. 3 is a partial end view of the second embodiment of the printing member of the present invention.

In a second embodiment, illustrated in FIG. 3, cylinder 20 does not participate in the printing process. Instead an additional layer 26, whose printing function corresponds to that performed by cylinder 20 in the first embodiment, is coated onto cylinder 20 in the manner described above. This material can be any polymer that provides the desired affinity for fountain solution and/or ink, but is preferably the secondary-ablation material described in the '705 patent As discussed in that application, polymeric materials that exhibit limited thermal stability, particularly those transparent to imaging radiation (or at least able to transmit such radiation with minimal scattering, refraction and attenuation), are optimal in this context. Such polymers include (but are not limited to) materials based on PMMA, polycarbonates, polyesters, polyurethanes, polystyrenes, styrene/acrylonitrile polymers, cellulosic ethers and esters, polyacetals, and combinations (e.g., copolymers or terpolymers) of the foregoing.

In an especially preferred dry-plate version of this embodiment, layer 26 is one of the acrylic materials disclosed in Examples 3–7 of the '705 patent, applied to a deposited weight of 1–10 $g/m^2$, and most preferably 4 $g/m^2$. This material exhibits good oleophilicity, and may be used with absorbing layers and silicone top coatings as described above.

Because the composition of cylinder 20 is unrelated to printing in this embodiment, it can be precisely selected for compatibility with rotating element 14, both in terms of frictional engagement and responsiveness to the means employed for expanding its diameter to fit over element 14 during installation and removal. For example, the nickel flexographic printing sleeves marketed by Stork Graphics, Charlotte, N.C., which expand in inner diameter when exposed to an interior source of air pressure, are well-suited to the present application.

Figure 4:
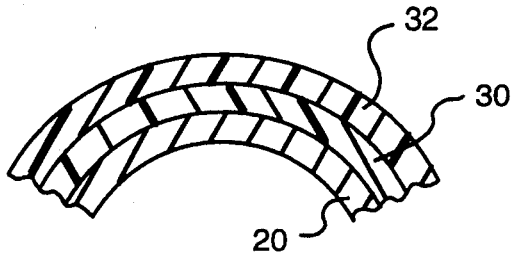
FIG. 4 is a partial end view of the third embodiment of the printing member of the present invention.

In a third embodiment, illustrated in FIG. 4, the metal cylinder 20 is hydrophilic. A hydrophilic cylinder surface can be obtained, for example, by coating a nickel sleeve with chromium (as described, for example, in U.S. Pat. No. 4,596,760, the entire disclosure of which is hereby incorporated by reference); or by utilizing an aluminum cylinder material that is grained and anodized (as described, for example, in U.S. Pat. Nos. 3,181,461 and 4,902,976, the entire disclosures of which are hereby incorporated by reference).

Cylinder 20 is coated with a layer 30 of standard lithographic photohardenable material, which is oleophilic and hydrophobic in nature. By "photohardenable," we mean that the material undergoes a change upon exposure to actinic radiation that alters its solubility characteristics to a developing solvent. Thus, exposed portions of layer 30 harden to withstand the action of developer, and are not removed by development from cylinder 20. Suitable materials are well-known in the art, and a comprehensive list of such materials is set forth in the '760, '461 and '976 patents, as well as in U.S. Pat. No. 5,102,756, the entire disclosure of which is hereby incorporated by reference. Most typically, the actinic radiation used to harden the photopolymer is within the visible or ultraviolet ("UV") portions of the electromagnetic spectrum.

Surrounding photohardenable layer 30 is a masking layer 32, which absorbs and ablates in response to IR radiation from the imaging laser, but which is opaque to the actinic radiation used to expose layer 30. Suitable examples of such materials include the masking layers described in the '756 patent, as well as the carbon-filled layers described in the '737 and '705 patents (which are black and therefore block the passage of visible light). Alternatively, layer 32 can include dyes that absorb in the visible or UV region, as described in the '705 patent (in sufficient concentration to effectively block passage of ambient actinic radiation), along with IR-absorptive dyes or pigments.

Laser imaging of masking layer 32 reveals selected portions of layer 30. Exposure of the entire construction to actinic radiation then anchors the photopolymer to cylinder 20 in the imagewise pattern used to ablate masking layer 32. That layer, along with unexposed portions of layer 30, is removed by subjecting the entire construction to a photographic fixing solution.

Figure 5:
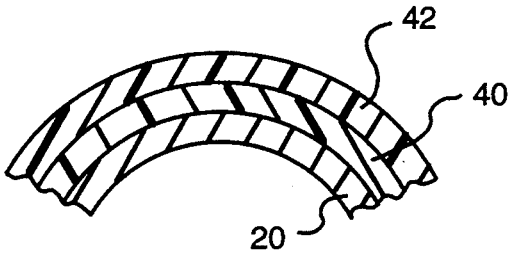
FIG. 5 is a partial end view of the fourth embodiment of the printing member of the present invention.

In a fourth embodiment, illustrated in FIG. 5, the metal cylinder is once again hydrophilic. Surrounding cylinder 20 is a thermally fusible layer 40 which, when exposed to laser radiation, adheres firmly to cylinder 20 and exhibits oleophilicity and hydrophobicity. Suitable for this purpose are the LAT materials described in U.S. Pat. Nos. 5,171,650; 5,156,938; 3,945,318; and 3,962,513, the entire disclosures of which are hereby incorporated by reference. Virtually any of the LAT materials appearing in these references can be utilized, so long as they exhibit sufficient oleophilicity, hydrophobicity, and post-exposure adhesion to a grain-anodized or plated metal surface.

Surrounding layer 40 is a withdrawal layer 42. This layer adheres more strongly to unexposed portions of layer 40 than those layers adhere to the surface of cylinder 20. However, layer 42 adheres less strongly to exposed portions of layer 40 than those layers, which have been exposed by laser radiation, adhere to the surface of cylinder 20. After imagewise exposure, stripping withdrawal layer 42 results also in removal of unexposed portions of layer 40, but leaves exposed portions of layer 40 adhered to cylinder 20. Layer 42 must therefore be transparent to the laser radiation that is used to fuse layer 40, and have sufficient structural integrity to facilitate convenient stripping.

Preferred materials for layer 42 include acrylic, methacrylic, or acrylic/methacrylic combination compositions containing a photoinitiator. Layers 40 and 42 may be applied, for example, by dip-coating; layer 42 is preferably deposited as a 100%-solids composition to a thickness of 0.001 to 0.005 inch, and cured in situ by exposure to UV radiation.

Alternatively, solvent-based cellulose compositions (containing plasticizers, as appropriate) can be used in lieu of acrylics and/or methacrylics, and are applied to a similar final thickness. However, because the solvent contributes to the initial bulk of the cellulosic layer, considerably thicker layers must be applied to achieve a final thickness, after the solvent has been driven off, of 0.001 to 0.005 inch. Suitable cellulose compositions include cellulose esters (e.g., cellulose acetate butyrate) and ethyl celluloses.

Following usage of the printing member, the coatings can be stripped from the cylinder by chemical means. This is most easily accomplished with the second embodiment, employing a material for cylinder 20 that is impervious to solvents capable of stripping layers 22, 24 and 26. For example, using a nickel cylinder 20, overlying acrylic, nitrocellulose and silicone layers can generally be stripped by immersing the printing member 10 in dilute (e.g., 5%) ammonia.

It will therefore be seen that we have developed a highly versatile system for manufacturing, using and recycling dry lithographic imaging members. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of manufacturing a lithographic member comprising:
   a. providing a hollow cylinder having an affinity for ink;
   b. coating thereon a first polymeric layer characterized by ablative absorption of imaging radiation;
   c. causing the first polymeric layer to assume a solid form;
   d. coating on the first polymeric layer a second polymeric layer having an affinity for an abhesive fluid for ink and which is not characterized by ablative absorption of imaging radiation; and
   e. causing the second polymeric layer to assume a solid form.

2. The method of claim 1 wherein the second polymeric layer is a polyvinyl alcohol chemical species.

3. A method of manufacturing a lithographic member comprising:
   a. providing a hollow cylinder;
   b. coating thereon a first polymeric layer having a selected affinity for at least one printing liquid selected from the group consisting of ink and an abhesive fluid for ink;
   c. causing the first polymeric layer to assume a solid form;

d. coating on the first polymeric layer a second polymeric layer characterized by ablative absorption of imaging radiation;

e. causing the second polymeric layer to assume a solid form;

f. coating on the second polymeric layer a third polymeric layer having an affinity for the at least one liquid which differs from the affinity of the first polymeric layer; and g. causing the third polymeric layer to assume a solid form.

4. The method of claim 3 further comprising the step of removing the first, second and third layers by dipping the printing member in a solvent.

5. The method of claim 4 wherein the solvent is ammonia.

6. The method of claim 4 wherein steps (a) through (g) are repeated following the removing step.

7. The method of claim 3 wherein the hollow cylinder is nickel.

8. The method of claim 3 wherein the third polymeric layer is a silicone chemical species.

9. The method of claim 3 wherein the third polymeric layer is a polyvinyl alcohol chemical species.

10. The method of claim 3 wherein the first polymeric layer is an acrylic.

11. A method of imaging a printing member comprising:

a. providing a seamless offset printing member comprising:

i. a hollow cylinder having an affinity for ink;

ii. coated thereon, a first polymeric layer characterized by ablative absorption of imaging radiation;

iii. coated on the first polymeric layer, a second polymeric layer having an affinity for an abhesive fluid for ink and which is not characterized by ablative absorption of imaging radiation; and b. removing the first and second layers in a pattern representative of an image.

12. The method of claim 11 further comprising the steps of:

c. mounting the offset printing member on an offset printing press;

d. conveying ink to the imaged offset printing member; and e. transferring ink from the offset printing member to a printing substrate in accordance with the pattern.

13. The method of claim 12 wherein the offset printing member is mounted on a mandrel coupled to the press, and further comprising the steps of:

f. disengaging at least one end of the mandrel;

g. removing the offset printing member; and h. removing the first and second layers by dipping the printing member in a solvent.

14. The method of claim 13 wherein steps (a) through (e) are repeated following the removing step.

15. A method of imaging a printing member comprising:

a. providing a seamless offset printing member comprising:

i. a hollow cylinder;

ii. coated thereon, a first polymeric layer having a selected affinity for at least one printing liquid selected from the group consisting of ink and an abhesive fluid for ink;

iii. coated on the first polymeric layer, a second polymeric layer characterized by ablative absorption of imaging radiation;

iv. coated on the second polymeric layer, a third polymeric layer having an affinity for the at least one liquid which differs from the affinity of the first polymeric layer; and b. imaging the offset printing member by removing the second and third layers in a pattern representative of an image.

16. The method of claim 15 further comprising the steps of:

c. mounting the offset printing member on an offset printing press;

d. conveying ink to the imaged offset printing member; and e. transferring ink from the offset printing member to a printing substrate in accordance with the pattern.

17. The method of claim 16 wherein the offset printing member is mounted on a mandrel coupled to the press, and further comprising the steps of:

f. disengaging at least one end of the mandrel;

g. removing the offset printing member; and h. removing the first, second and third layers by dipping the printing member in a solvent.

18. The method of claim 17 wherein steps (a) through (e) are repeated following the removing step.

19. An offset printing member comprising:

a. a hollow cylinder having an affinity for ink;

b. coated thereon, a first polymeric layer characterized by ablative absorption of imaging radiation; and c. coated on the first polymeric layer, a second polymeric layer having an affinity for an abhesive fluid for ink and which is not characterized by ablative absorption of imaging radiation.

20. The member of claim 19 wherein the cylinder is polyester.

21. An offset printing member comprising:

a. a hollow cylinder;

b. coated thereon, a first polymeric layer having a selected affinity for at least one printing liquid selected from the group consisting of ink and an abhesive fluid for ink;

c. coated on the first polymeric layer, a second polymeric layer characterized by ablative absorption of imaging radiation; and d. coated on the second polymeric layer, a third polymeric layer having an affinity for the at least one liquid which differs from the affinity of the first polymeric layer.

22. The member of claim 21 wherein the hollow cylinder is nickel.

23. The member of claim 21 wherein the third polymeric layer is a silicone chemical species.

24. The member of claim 21 wherein the third polymeric layer is a polyvinyl alcohol chemical species.

25. The member of claim 21 wherein the first polymeric layer is an acrylic.

* * * * *